US005918699A

United States Patent [19]

Summers

[11] Patent Number: 5,918,699

[45] Date of Patent: Jul. 6, 1999

[54] LADDER ANCHORING SYSTEM

[76] Inventor: James A. Summers, 100 Petigro Rd, Pawleys Island, S.C. 29585

[21] Appl. No.: 09/024,766

[22] Filed: Feb. 17, 1998

[51] Int. Cl.[6] ..... E06C 5/36

[52] U.S. Cl. ..... 182/107; 248/500; 52/156

[58] Field of Search ..... 248/500, 507; 182/107, 129; 52/156

[56] References Cited

U.S. PATENT DOCUMENTS 1,431,154 10/1922 Dilger .

*Primary Examiner*—Alvin Chin-Shue

*Attorney, Agent, or Firm*—Goldstein & Canino

[57] ABSTRACT

A ladder anchoring system, for securing a ladder to a ground surface, the ladder having a lowest rung which has a lowest rung length. The anchoring device comprises a pair of spikes and a pair of retaining arms. Each spike is continuous with one of the retaining arms. The retaining arms each have a downturned portion for engaging the lowest rung of the ladder when the spikes are fully inserted into the ground surface. The spikes are spaced apart a distance substantially equal to the lowest rung length with a primary cross support. Additional rigidity is provided by a pair of arcuate supports which extend between the spikes and the primary cross support, and a secondary cross support, which extends between the arcuate supports.

3 Claims, 2 Drawing Sheets

LADDER ANCHORING SYSTEM

BACKGROUND OF THE INVENTION

The invention relates to a ladder anchoring system. More particularly, the invention relates to a device which engages a ladder at the lowest rung of said ladder, and is inserted into the ground to stabilize the ladder and prevent inadvertent movement thereof.

A ladder is a tool used by people in almost any trade. A ladder makes inaccessible locations suddenly accessible. However there are certain dangers associated with ladder use. Level ground is not always present, and often workers can only try their best to stabilize the ladder before climbing. However, even when placed on level ground against a solid building, a ladder can become more and more unstable as the user climbs. The ladder can easily "kick-out" from the building surface, or slide laterally on the building surface and fall. A falling ladder not only injures the worker climbing the ladder, but can easily injure others working in the vicinity.

Homeowners tend to use ladders even more than tradespeople. However, for the typical homeowner, climbing a ladder is not an everyday occurence. Thus, many homeowners climb ladders properly positioning the ladder first. As a result countless homeowners are injured every year when the ladder they climb falls. Many of these injuries could be prevented if the ladder were properly anchored before it were climbed.

U.S. Pat. No. 530,374 to Wilkens discloses a ladder attachment that is pivotably attached at the bottom of the ladder. The attachment has short studs for securing to the ground, and folds up against the ladder when not in use. Since the studs are always jutting out from the attachment near the end of the ladder, they can easily injure people while carrying the ladder.

U.S. Pat. No. 2,523,535 to Little discloses an adjustable ladder anchor which employs a stake that is tethered to the lowest ladder rung with a cord. Since Little extends close to the ground for a considerable distance from the bottom of ladder, it creates a tripping hazard for people walking by the base of the ladder. If someone trips on the anchor, it is very likely that it will pull the ladder down, additionally injuring the person on the ladder.

U.S. Pat. No. 5,054,579 to Moson discloses a ladder having an anchoring system. The anchoring system in Moson is simply a pair of ordinary stakes which each have a hook for engaging the lowest ladder rung. There is no rigid physical connection between the stakes. Thus, there is a great possibility that one stake will be driven in deeper than the other, giving the ladder a tendency to pitch to one side.

While these units may be suitable for the particular purpose employed, or for general use, they would not be as suitable for the purposes of the present invention as disclosed hereafter.

SUMMARY OF THE INVENTION

It is an object of the invention to produce a ladder anchoring system which effectively secures a ladder to the ground, to make the ladder more stable, and thus prevent the ladder from falling.

It is another object of the invention to produce a ladder anchoring system which employs a pair of spikes which extend into the ground a considerable distance, to provide a superior anchoring for the ladder.

It is yet another object of the invention to produce a ladder anchoring system which provides a rigid framework between the spikes for ensuring even insertion into the ground and load distribution.

The invention is a ladder anchoring system, for securing a ladder to a ground surface, the ladder having a lowest rung which has a lowest rung length. The anchoring device comprises a pair of spikes and a pair of retaining arms. Each spike is continuous with one of the retaining arms. The retaining arms each have a downturned portion for engaging the lowest rung of the ladder when the spikes are fully inserted into the ground surface. The spikes are spaced apart a distance substantially equal to the lowest rung length with a primary cross support. Additional rigidity is provided by a pair of arcuate supports which extend between the spikes and the primary cross support, and a secondary cross support, which extends between the arcuate supports.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
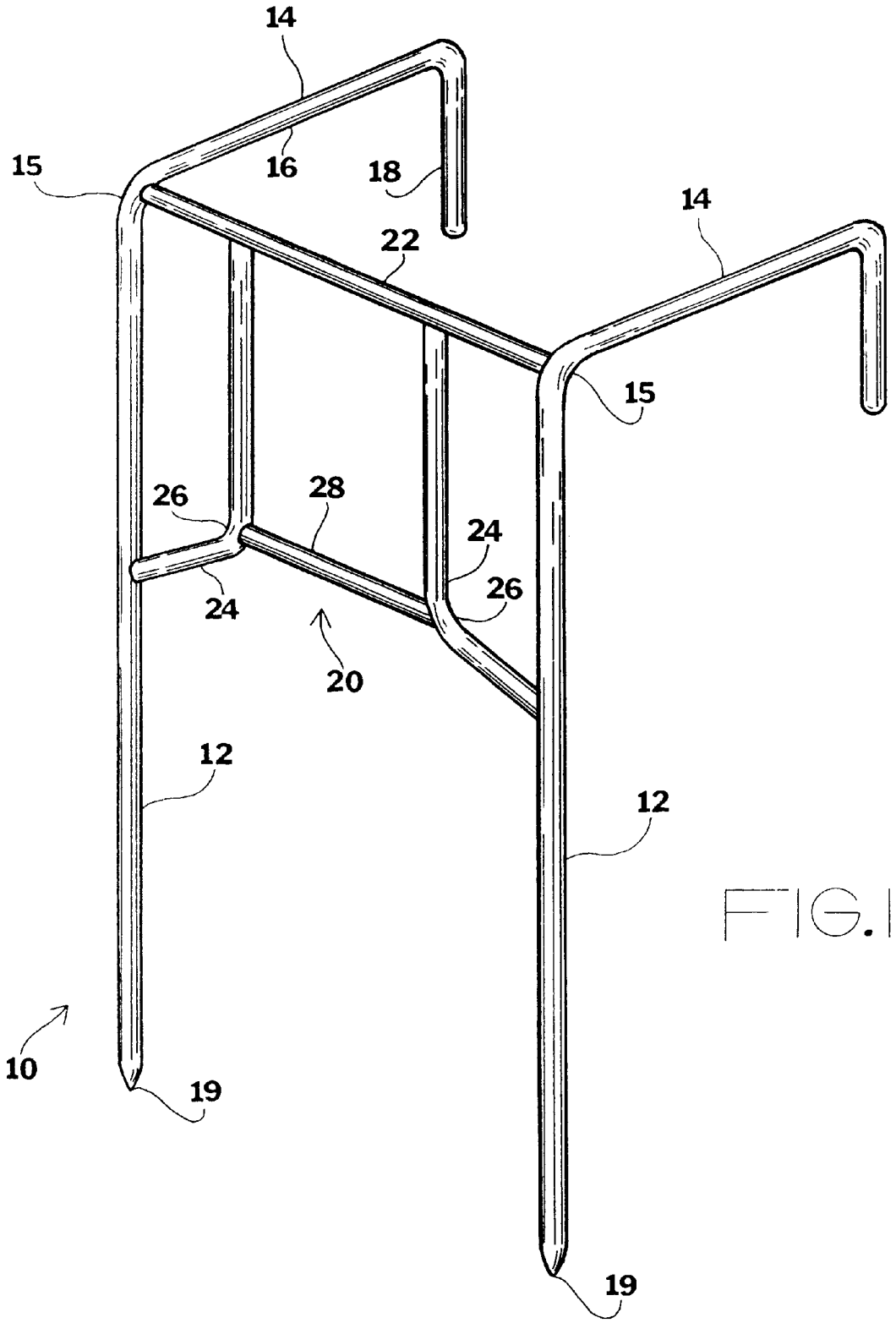
FIG. 1 is a diagrammatic perspective view, illustrating the ladder anchoring device, per se.

FIG. 1 illustrates a ladder anchor 10, comprising a pair of spikes 12, and a pair of retaining arms 14. Each spike 12 is attached to one of the retaining arms 14 at a junction 15. The retaining arm comprises a horizontal portion 16, and a downturned portion 18. Preferably, the each of the spikes 12 and their associated retaining arms 14 are made from a continuous piece of material. A suitable material is tubular or solid metal that is bent once substantially ninety degrees between the spike 12 and horizontal portion 16 of the retaining arm, and bent once again substantially ninety degrees between the horizontal portion 16 and the downturned portion 18. Each spike 12 has a point 19, which is fully opposite the junction 15 with the retaining arm 14. The point 19 facilitates insertion into gravel, sand, and even densely packed soil.

A rigid framework 20 connects the spikes 12 with each other. The rigid framework includes a primary cross support 22, which connects the two spikes at their junctions 15. In addition, the frame work comprises a pair of arcuate supports 24, which each extend from one of the spikes to the primary cross support 22. Each arcuate support 24 has an angular bend 26. Still further rigidity and load distribution is provided by a secondary cross support 28 which connects the two arcuate supports 24. The secondary cross support 28 extends between the angular bends 26 of the arcuate supports 24.

Figure 2:
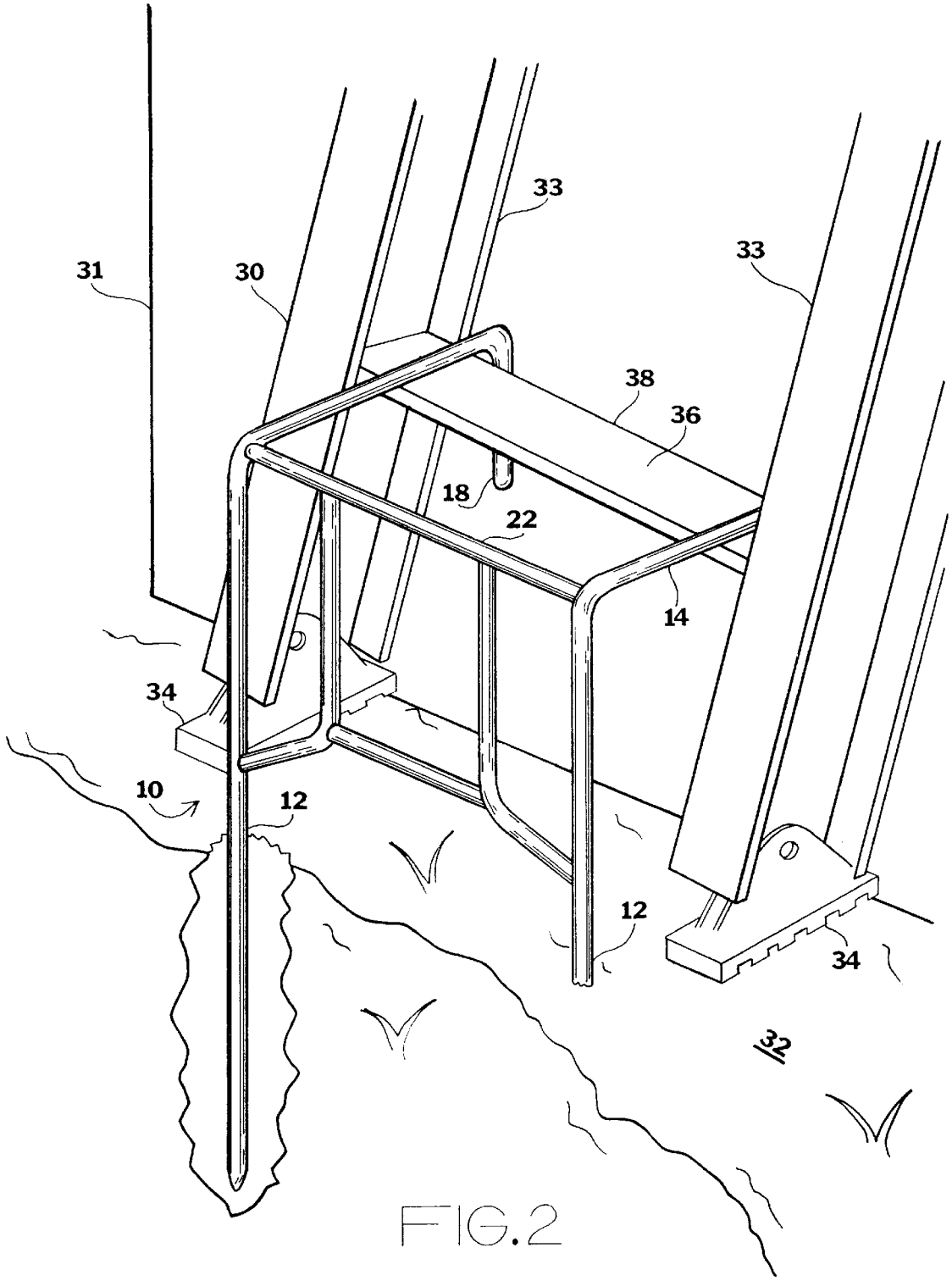
FIG. 2 is a diagrammatic perspective view, illustrating the ladder anchoring device in use, wherein the spikes have been inserted into the ground, and the retaining arms have been secured onto the lowest rung of a ladder.

FIG. 2 illustrates the ladder anchor 10 in use. A ladder 30 is leaned against a building 31, and is resting upon a ground surface 32. The ladder 10 has a pair of side rails 33 and a pair of feet 34 which engage the ground surface 32 beneath each of the side rails 33. A lowest rung 36 extends between the side rails 33, the lowest rung 36 immediately above the feet 34. A lowest rung length 38 is defined as the distance between the rails 33.

Once the ladder is leaned against the building 31 at a suitable angle, and the feet 34 are adjusted to make the ladder 30 as stable as possible, the ladder anchor 10 is used to further stabilize the ladder 30. The spikes 12 are inserted into the ground, and the retaining arms 14 are positioned so that the downturned portion 18 thereof can easily grab behind the lowest rung 36. The spikes 12 are pushed or driven downward until the lowest rung 36 is pulled tightly downward by the retaining arms 14. To ensure the most stability, the primary cross support 22 should be substantially the length of the lowest rung 38, and extend parallel thereto, as illustrated in FIG. 2.

In conclusion, herein is presented a ladder anchoring system which attaches between the lowest rung of a ladder and a ground surface to stabilize the ladder and prevent inadvertent movement thereof.

What is claimed is:

1. A ladder anchoring system, for use with a ladder having a bottom rung having a rung length, and for securing said ladder to a ground surface, comprising:

a pair of straight, vertically extending spikes, each spike having a pointed end;

a pair of retaining arms, each retaining arm attached directly to one of the spikes opposite the pointed end, the retaining arms having a downwardly turned portion, for selectively engaging the bottom rung of the ladder, said spike having a length greater than the length of said downwardly turned portion; and a cross support comprising a primary cross support and a secondary cross support, said primary cross support extending substantially straight between the spikes, for spacing the spikes apart a distance substantially the rung length, said cross support substantially parallel to both of said spikes, further comprising a pair of arcuate supports, the arcuate supports each extends from a respective spike to a location on the primary cross support spaced from the spikes, the secondary cross support extending between the arcuate support, the arcuate supports, the cross supports and the spikes all extending in substantially the same plane.

2. The ladder anchoring system as recited in claim 1, wherein each of the spikes is adjoined with one of the retaining arms at a junction, and wherein the primary cross support extends between the junctions.

3. The ladder anchoring system as recited in claim 2, wherein each of the arcuate supports have an angular bend, and wherein the secondary cross support extends between the angular bends of each of the two arcuate supports.

* * * * *